US005725157A

United States Patent [19]

DeLuca

[11] Patent Number: 5,725,157

[45] Date of Patent: Mar. 10, 1998

[54] INJECTOR NOZZLE VALVE

[75] Inventor: Frank DeLuca, Enfield, Conn.

[73] Assignee: Buescher, Alfred J., Shaker Heights, Ohio

[21] Appl. No.: 523,952

[22] Filed: Sep. 6, 1995

[51] Int. Cl.[6] ..... F02M 61/20

[52] U.S. Cl. ..... 239/533.9; 239/533.3

[58] Field of Search ..... 239/533.1–533.3, 239/533.9

[56] References Cited

U.S. PATENT DOCUMENTS 1,952,816 3/1934 Mock .
4,153,205 5/1979 Parrish, Jr. ..... 239/533.9
5,033,679 7/1991 Golev et al. ..... 239/533.3
5,163,621 11/1992 Kato et al. ..... 239/533.12

FOREIGN PATENT DOCUMENTS 3-117674 5/1991 Japan ..... 239/533.3

*Primary Examiner*—Lesley D. Morris
*Attorney, Agent, or Firm*—Pearne, Gordon, McCoy & Granger LLP

[57] ABSTRACT

The conical nozzle valve seat of a diesel injection nozzle is shaped to form a notch extending down from an annular upper notch boundary on the bottom face (seat) of the valve. The notch boundary is of a greater diameter than the annular entry edge of the sac and the minimum cross-sectional flow area of the valve is greater than that associated with an otherwise identical valve that does not have such annular notching.

10 Claims, 2 Drawing Sheets

INJECTOR NOZZLE VALVE

FIELD OF THE INVENTION

This invention relates to diesel engine fuel injectors and particularly to novel injector nozzles and injector valves.

BACKGROUND

The sac volume of nozzles used in diesel engines contribute considerably to the engine exhaust emissions such as smoke and unburned hydrocarbons. It is desirable, therefore, to reduce the sac volume to a value as small as possible consistent with acceptable standards for nozzle performance. Reducing nozzle sac volume is generally an act of design compromise because one or more of the interrelating physical characteristics are compromised when one is changed to achieve the sac volume reduction.

Valve lift is an important consideration in injection valve design. In some high rated engines the valve does not close fast enough to prevent some blow back of combustion gases into the nozzle sac through the orifices at the end of injection. This causes two actions to occur. First, during the engine expansion stroke a mixture of fuel and the blow back gases are expelled from the sac into the combustion chamber late in the cycle resulting in unburned hydrocarbons; and second, the valve tip heats up sufficiently to cause traces of the fuel to coke up and deposit in and around the nozzle orifices over long operating periods. With reduced nozzle valve lift the valve seats in a shorter period of time and closes while the fuel is still flowing out of the orifices into the combustion chamber preventing any combustion gas blow back. Superficially, it may appear to be a simple matter to select a size of nozzle body and valve to provide all the characteristics desired, but this is not the case because in engine design it is most desirable to use the smallest size nozzle to perform the desired functions. This requirement sets limits on the optimum interrelationship of all the nozzle physical characteristics which includes as a high priority nozzle durability attributes.

Other requirements must be balanced relative to each other to keep the nozzle as small as possible and the sac volume small while providing a sufficiently large flow area past the valve seat to allow the fuel to flow unrestricted (without excessive pressure drop) to the nozzle orifices. The area past the valve seat can be increased easily by increasing the valve lift but this cannot be done without causing other problems such as excessive stresses on the nozzle body and valve seat and excessive stresses on the nozzle holder pressure adjusting spring 12. It also increases the length of time it takes for the nozzle valve to seat which is unacceptable for the reasons stated earlier. Therefore, other means must be devised to achieve an optimum balance of all the desirable characteristics for nozzles used in large diesel engines.

BRIEF DESCRIPTION OF THE INVENTION

The present invention opens the way to reducing sac volume significantly without compromising mechanical integrity of the nozzle body, flow area past the valve seat, or quickness of seating. The invention provides manufacturers of large diesel engines a fuel injection nozzle that assists the engine designer in his efforts to reduce engine exhaust unburned hydrocarbons and smoke. This is done by making it possible to minimize the volume of fuel remaining in the nozzle sac when the nozzle valve seats and fuel injection ends, but in such a way as to minimally compromise, or even preserve or enhance, mechanical integrity of the nozzle body and flow area past the valve seat, while at the same time limiting the size of the nozzle, the degree of valve lift, and the closing time at end of injection.

An important advantage of the invention is that it provides for adequate flow area past the nozzle valve seat in a manner which allows better balancing of other design criteria, including providing relatively low lift to limit the time for the valve to close at the end of injection.

The sac volume of injection nozzles is governed to a great extent by the size of the nozzle which is directly related to the number and size of orifices required to atomize the fuel delivered to it by the injection pump in the time required by the engine combustion process, usually measured in engine crankshaft degrees. Therefore, the larger the engine, the greater the number of orifices and size are required. This in turn determines the sac diameter and in general practice the angle defining the nozzle valve seat and corresponding nozzle body seat. In common practice either a 90° or 60° seat is used depending upon the number and size of the nozzle orifices and the size of the sac diameter selected. The smaller angle seats, such as the 60° seat, have a relatively restricted flow area for a given lift. This design restraint is removed by the present invention which provides a way to maintain adequate flow area when lift is reduced, regardless of valve seat angle, by suitably notching the valve seat in the vicinity of the sac inlet edge in a manner to open up the bottleneck or restriction in flow area that occurs in this region. Therefore, the invention has particular application to valves employing seats of a relatively small angle, such as 60°, but it also is applicable to valves having larger seat angles such as 90°.

The invention will be more fully understood from the detailed description below, taken together with the accompanying drawings.

DETAILED DESCRIPTION OF THE INVENTION

Figure 1:
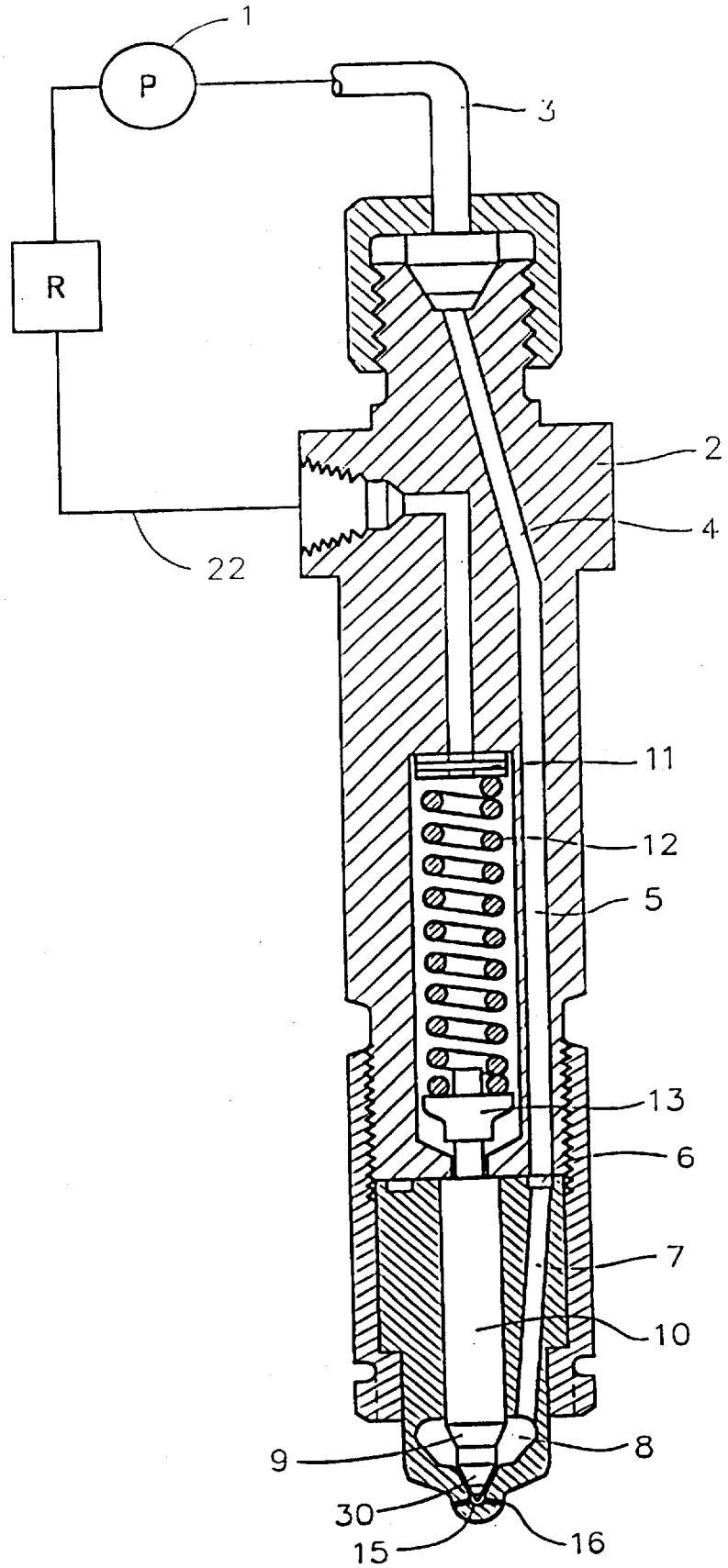
FIG. 1 is a schematic showing a large engine injection system, and illustrating in cross-section an injection nozzle embodying the invention.
Figure 5:
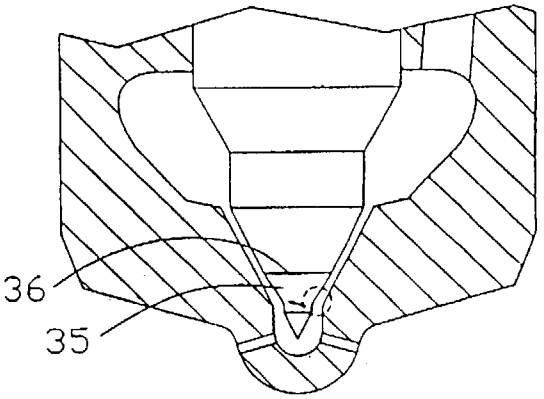
FIG. 5 is a cross-sectional view, on the same scale as FIGS. 2 and 3, showing an injector that embodies the invention. The valve of the injector shown in FIG. 5 has the same degree of maximum valve lift as the injectors shown in FIGS. 2 and 3.

The injection system shown in FIG. 1 includes the novel nozzle of FIG. 5, but otherwise illustrates a typical injection system consisting of an injection pump 1, a nozzle and holder assembly 2 and a high pressure connecting tubing 3. The pump supplies high pressure metered fuel to the nozzle holder assembly 2 through the high pressure tubing. The fuel flows through ducts 4 and 5 into the nozzle annulus 6, through the multiple fuel ducts 7 which are annularly spaced 120° from each other (two ducts not shown) and into the nozzle sump or nozzle body chamber 8 where it acts on the differential area 9 of the nozzle valve 10. When the injection pressure in nozzle sump 8 reaches the nozzle opening pressure, which is preset to a prescribed opening pressure by means of the pressure adjusting shims 11, the nozzle valve 10 lifts against the force of the spring 12 applied through the lower spring seat 13. When the valve 10 lifts, fuel flows past the valve seat or face 30 and body seat into the nozzle sac 15 from which fuel is then discharged through the nozzle orifices 16 and atomized in preparation for ignition and combustion. When fuel delivery by the pump 1 ceases, the nozzle valve closes and injection ends. A return line 22 is connected for drainage from the nozzle holder 2 to the reservoir R.

Figure 2:
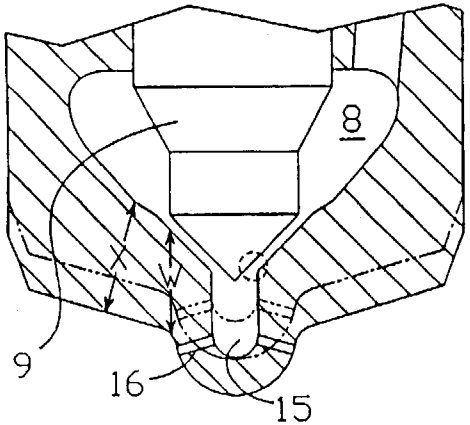
FIG. 2 (PRIOR ART)
FIG. 2 is a cross-sectional view on an enlarged scale showing the lower section of a typical large engine nozzle of the prior art having a 90° seat and the normally large sac volume. The valve of the illustrated nozzle is shown in fully open position (maximum lift). A modification of the structure is shown in phantom, and is not presented as or admitted to be prior art.

A typical 90° seat valve of the prior art is illustrated in FIG. 2. The illustrated injection valve has a valve seat 30*a* and a body seat 31*a*, both having an included angle of 90°. The valve is urged to closed position by a spring such as the spring 12 (not shown in FIG. 2). The valve is shown in its fully open or raised position, which is defined by stop means such as the bottom of the main body of the holder assembly 2 as seen in FIG. 1. Fuel under high pressure is fed to the body sump or chamber 8. When the pressure gets high enough, the normally closed and seated valve is opened by the pressure acting axially against the differential area or face 9. As soon as the valve seat 30*a* comes off the body seat 31*a*, the entire cross section of the valve is subjected to the opening pressure.

When the valve opens, fuel enters the sac 15 and then flows out the injection orifices which open from the sac to the interior of the combustion chamber. At the end of the injection cycle, the valve closes when the pressure in the sump or chamber 8 drops to the point where it cannot overcome the spring loading of the valve even though such pressure is acting on the entire cross section of the valve.

Figure 3:
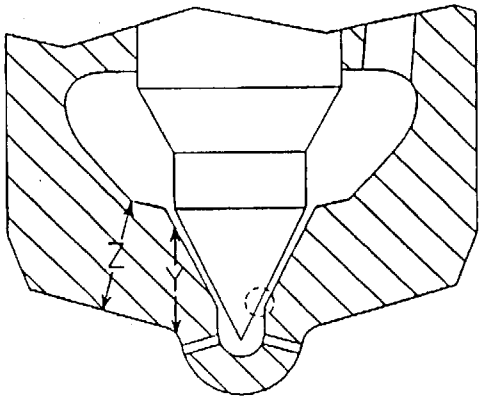
FIG. 3 is a cross-sectional view showing a modification of the nozzle of FIG. 2 and having the same degree of valve lift as the nozzle of FIG. 2 but with the valve and body seats changed to 60° so that the valve seat end seats farther down into the body to reduce the sac volume dramatically. Again, the valve of the illustrated nozzle is shown in fully open position (maximum lift). This drawing is presented for analytical purposes, and is not presented as or admitted to be prior art. (The construction of FIG. 3 would be of limited or no practical value because its cross-sectional flow area is sharply restricted as compared to that of the nozzle shown in FIG. 2 for the same degree of lift.)

FIG. 3 shows another design of valve. This valve is similar to the one shown in FIG. 2 except that in FIG. 3, the valve seat 30*b* and body seat 31*b* each have an included angle of 60° instead of 90°.

Figure 4:
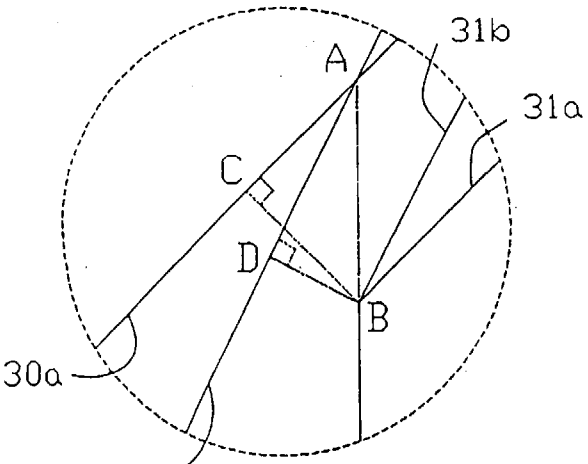
FIG. 4 is a diagrammatic view on an enlarged scale of the portions of FIGS. 2 and 3 indicated therein by small dashed circles, comparing the minimum cross-sectional flow areas of the valves of FIGS. 2 and 3, that is, comparing the flow areas at the entry edges of the sacs of the two valves.

FIG. 4 is an enlarged diagrammatic view comparing the circled parts of FIGS. 2 and 3. The valves of FIGS. 2 and 3 have exactly the same lift, indicated by the line AB in FIG. 4. However, the cross-sectional flow area at the inlet edge (point B in FIG. 4) of the sac is much smaller for the 60° valve of FIG. 3 than it is for the 90° valve of FIG. 2, as may be seen by comparing the lengths of the lines BD and BC in FIG. 4.

A 60° valve has certain advantages over a 90° valve, including a more rugged lower housing shape for the same sac length, to be more fully discussed and quantified below. However, the reduced flow area associated with the 60° valve is a serious disadvantage. The flow area can be increased by increasing valve lift, but as previously noted serious problems are associated with excessive lift, such as excessive stresses on the nozzle body and valve seats and on the valve spring, and increased time taken for the valve to seat.

In one particular illustrative aspect, the present invention provides a 60° valve with a flow area as large as the flow area associated with a 90° valve having the same lift. This is done by relieving or notching the valve seat by a notch 35 in the vicinity of the inlet edge of the sac, as seen in FIG. 5. The circled area in FIG. 5 is enlarged and shown in FIG. 5A in order to compare the notch dimensions with the lines AB, BC and BD, previously described in connection with FIG. 4. From FIG. 5A it will be seen that the cross-sectional flow area associated with a 90° valve and with the line BC also applies to the illustrated 60° valve.

Of course, the greater the diameter at which cross-sectional flow area is calculated, the greater the flow area for a given spacing between the valve seat and body seat. The upper boundary or edge 36 of the notch 35 is preferably located at that point where the diameter is just sufficient, with the spacing BD applying between the valve seat and the body seat, to provide the same flow area as is provided at the sac inlet edge by the spacing BC. Alternatively, the edge 36 may be located at a slightly higher point so as to result in a slightly higher flow area at such edge 36, but at the cost of slightly reducing the area available for maintaining the valve seating stress within acceptable limits. The boundary or edge 36 need not be an intersection of two conical surfaces, but may be faired so long as this is done in such a way that the flow area in the region is not reduced below the desired minimum.

Figure 5A:
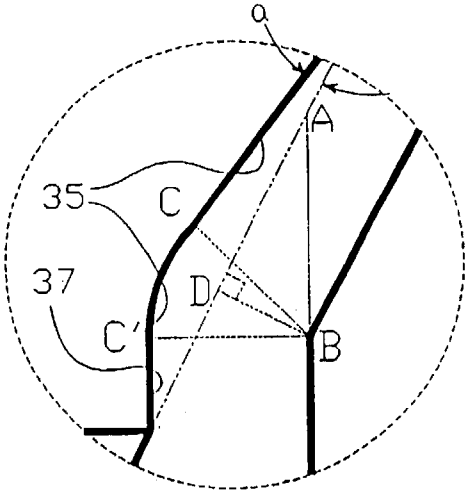
FIG. 5A is a diagrammatic view on the same scale as FIG. 4, of the portion of FIG. 5 indicated therein by a small dashed circle, and compares certain dimensions of the notch seen in FIG. 5 with the dimensions of imaginary lines AB, BC and BD, which will be referred to in connection with FIG. 4. The bold lines illustrate physical structure as distinguished from imaginary lines.

Preferably, the lower part of the notch is a cylindrical surface 37 as shown, and is spaced from the sidewall of the sac by the distance BC' which should be at least slightly greater than the distance BC in order not to restrict the flow area, since the center of line BC' describes a circle around the central axis of the nozzle having a radius slightly smaller than the radius of a circle described by the central point of the line BC. The upper conical portion of the notch 35 and the lower cylindrical portion 37 are preferably faired into each other by a gentle curve or fillet as seen in FIG. 5A.

Specific typical dimensions for the valves discussed above may be mentioned. For example, the valve lift represented by the line AB may be 0.40 mm, and the sac diameter may be say 1.778 mm. The line BC in FIG. 4 represents a cut across the cross-sectional flow area past the inlet edge of the sac in the 90° valve of FIG. 2. By simple trigonometric calculation, the cross-sectional flow area past the inlet edge of the sac that corresponds to the given dimensions is the length of the line BC times $\pi$ times the diameter of the circle generated by the midpoint of line BC around the axis of the nozzle. This calculates out to 1.402 $mm^2$.

In order to reduce the sac volume and still maintain the same nozzle body thickness at sections W and X it is necessary to change the valve seat angle from 90° to 60°. This fact is demonstrated in the phantom view in FIG. 2 in which the sac size for the 90° seat nozzle is made identical to that of the 60° seat nozzle shown in FIG. 3. Note that the sac volume of the FIG. 3, 60° seat nozzle with the valve in its fully seated position, would be much smaller than the sac volume of the FIG. 2 phantom 90° seat nozzle, and in addition the nozzle body sections W and X would be much smaller for the 90° seat phantom nozzle than the corresponding body sections Y and Z of the 60° seat nozzle. It is evident, therefore, that a reduced seat angle, such as the 60° seat angle shown, must be used if it is desired to reduce the sac volume and at the same time retain the mechanical integrity of the original 90° seat nozzle body. (Practical values for the 90° valve body sections are, say, 3.3 mm for dimension W and 3.65 mm for dimension X. For the 60° valve body, corresponding dimensions Y and Z are actually slightly increased to 3.4 and 3.75 mm respectively. In the FIG. 2 phantom 90° nozzle seat, the body sections W and X would be greatly reduced to respectively only 2.35 and 2.6 mm.)

However, at the same 0.40 mm valve lift and 1.778 mm sac diameter used to compare the flow area past the valve seats, the flow area of 1.402 $mm^2$ for the 90° seat nozzle is reduced to 1.008 $mm^2$ for the 60° seat nozzle, as may be readily calculated. In this calculation, the line BD in FIG. 4 represents a cut across the cross-sectional flow area past the inlet edge of the sac in the valve of FIG. 3. By simple geometry, the cross-sectional flow area past the inlet edge of the sac that corresponds to the given dimensions is the length of the line BD (a simple trigonometric function of the lift distance, the sac diameter and the included angle of the valve) times $\pi$ times the diameter of the circle generated by the midpoint of line BD around the axis of the nozzle (such diameter being another simple trigonometric function of the same variables), producing the calculated result of 1.008 $mm^2$.

This reduced flow area is unacceptable, as the flow areas must remain the same for satisfactory operation of the nozzle in the engine. This flow area deficiency is corrected by the novel valve design previously described and shown in FIG. 5, in which the notch 35 is machined in the valve seat. The flow area at the sac inlet edge B in FIG. 5A, defined by the line BC, is 1.402 $mm^2$, the same flow area as the FIG. 2 90° valve. The notch 35 has the upper notch edge 36 whose diameter is larger than the sac diameter, and is such that the flow area at the notch edge 36 is the same as the 1.402 $mm^2$ flow area at the sac inlet edge B in FIG. 5A. Simple trigonometric calculation shows that at a diameter of 2.059 mm on the conical valve seat, the cross-sectional flow area, when the valve is lifted 0.4 mm, is such value of 1.402 $mm^2$. Therefore the notch edge 36 is located at such vertical position on the valve seat as to give it a diameter of 2.059 mm.

As mentioned above, the cylindrical surface 37 which preferably forms the lower part of the notch 35 is spaced from the sidewall of the sac by a distance BC' which should be slightly greater than the distance BC to maintain the flow area. Since the flow area between these two cylindrical surfaces is the difference in the areas of two circles which have the same diameters as the two surfaces, the diameter of the cylindrical surface 37 which will produce a given flow area with a given sac diameter can be readily calculated by simple algebra. To produce the previously referred to flow area of 1.402 $mm^2$ with the previously referred to sac diameter of 1.778 mm, the diameter of the cylindrical surface 37 calculates out to 1.173 mm.

The diameter of the cylindrical portion of the notch can be smaller than that which will maintain the same flow area, i.e., smaller than 1.173 mm in the example given, but the cost of any such decrease in this diameter is a slight increase of sac volume at fully closed condition.

Figure 6:
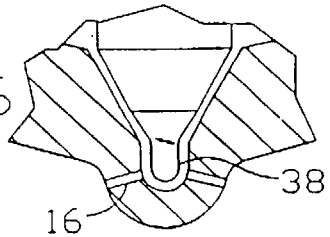
FIG. 6 is a view similar to the lower portion of FIG. 5 showing another embodiment of the invention, again with the illustrated valve having the same degree of maximum valve lift as the injectors shown in FIGS. 2 and 3.

The invention further contemplates further reducing sac volume in the closed condition of the valve by reshaping the lower extremity of the valve to more completely fill the sac volume while at the same time maintaining adequate flow area. FIG. 6 shows such a valve with such a reshaped valve lower portion formed by extending the cylindrical portion to form a cylindrical extension 38 which projects below the imaginary cone in which lies the portion of the valve seat that is above the notch boundary 36. This valve lower extremity may terminate in a hemispherical bottom as shown, or may form a flat circular bottom, a small conical bottom, or other shape. Since the portion of the sac below the level of the inlets to the nozzle orifices 16 is a region of little or no fuel through-put, it is not necessary at this region to maintain the cross-sectional flow area which applies at upstream locations. The valve of FIG. 6 or similar valves with reshaped lower extremities will generally be more costly to manufacture than valves shaped within an imaginary conical envelope, as is the valve of FIG. 5. It is known to provide a valve having a lower extremity protruding below the imaginary cone of the valve seat, but not in association with notching in the vicinity of the sac inlet edge so as to increase the flow past what it would otherwise be for a valve of the same seat angle, as presently disclosed.

It should be clear from the above that machining a notch in the seat of a 60° seat nozzle valve in the vicinity of the sac entry edge will permit the valve to provide the same flow area past the body seat as obtained with a 90° seat nozzle at the same valve lift. It should also be clear from comparing FIGS. 2, 3 and the phantom view in FIG. 2 that sac volume cannot be reduced significantly with conventional design 90° seat nozzles used in large diesel engines. Note in making the sac length the same as with the 60° seat nozzle sac, the sac volume is larger with the 90° seat nozzle and in addition the nozzle body sections at W and X are reduced about 29 percent, greatly weakening the nozzle body structure. It is also obvious from FIG. 3 that in 60° seat nozzles of conventional design, the flow area past the valve seat at a normally acceptable valve lift is inadequate and unacceptable for nozzles used in large diesel engines, and it should now be clear how the present invention removes this restraint.

From the above it should be apparent how the present invention opens the way to reducing sac volume significantly without compromising mechanical integrity of the nozzle body or flow area past the valve seat, and how the invention makes it possible to minimize the volume of fuel remaining in the nozzle sac when the nozzle valve seats and fuel injection ends, but in such a way as to minimally compromise, or even preserve or enhance, mechanical integrity of the nozzle body and flow area past the valve seat, while at the same time limiting the size of the nozzle, the degree of valve lift, and the closing time at end of injection.

The invention is not to be limited to details of the above disclosure, which are given by way of example and not by way of limitation. Many refinements, changes and additions are possible in addition to the alternatives discussed above. For example, the valve seats and body seats are shown as strictly complementary to each other, but the included angle of the valve seat may very slightly exceed that of the body seat in order to properly establish the sealing location at the top of the valve seat in accordance with accepted practice, the valve seat and the body seat remaining however generally complementary to each other. Also, although the flow area at the upper notch boundary may be at the desired minimum, the notch may be shaped so that the flow areas at at least some lower locations are somewhat above the desired minimum; however, in general there would be no particular gain in such a design.

What is claimed is:

1. In a diesel injection nozzle comprising a nozzle body chamber, a sac below said body chamber, said sac having an annular entry edge at its top past which fluid flows when passing from said body chamber to said sac, an open-centered conical body seat at the bottom of the chamber and ending at said annular entry edge, a plurality of injection orifices spaced below said body seat in said sac and opening from said sac to the exterior of said injection nozzle, a valve extending through the body chamber and having a conical bottom face or seat generally complementary to said body seat and having a given included angle, said valve and valve seat being movable to a seated position in sealing relation against said body seat to cut off fluid flow to said sac, a spring urging said valve to said seated position, said valve having a differential-area portion exposed to said nozzle body chamber whereby the valve is urged upwardly from said seated position to a fully raised position, said upward urging being by hydraulic pressure in said chamber and being against the bias of said spring, said conical bottom face or seat of said valve, in the said fully raised position of said valve, extending down the majority of the axial extent of said conical body seat from the top thereof along the axial length thereof and into the vicinity of said annular entry edge of said sac, and said valve in said fully raised position providing a given minimum cross-sectional flow area for fluid passing from said injection nozzle chamber to said sac, the improvement wherein said conical bottom face or seat of said valve is annularly notched at said vicinity of said annular entry edge of said sac, said annular notching forming an annular notch extending down from an annular upper notch boundary on said conical bottom face of said valve, said upper notch boundary being of a greater diameter than said annular entry edge of said sack whereby said minimum cross-sectional flow area is greater than that associated with an otherwise identical valve that does not have such annular notching.

2. A device as in claim 1, said notch being in a form which includes a conical notch surface extending downward from said upper notch boundary and forming a greater included angle than said given included angle at which said conical bottom face of said valve is formed.

3. A device as in claim 2, said notch being in a form which further includes a second notch surface extending below said first-named notch surface downward toward a lower notch boundary.

4. A device as in claim 2, said notch being in a form which further includes a second notch surface extending below said first-named notch surface, said second notch surface being cylindrical.

5. A device as in claim 4, said cylindrical second notch surface being spaced from the sidewall of said sac a distance such that such minimum cross-sectional flow area applies along the length of said cylindrical second notch surface.

6. A device as in claim 5, the bottom extremity of said valve being formed as a conical surface lying in the same imaginary cone as does the portion of said bottom face that is above said upper notch boundary.

7. A device as in claim 5, said cylindrical second notch surface extending below the imaginary cone in which lies the portion of said bottom face that is above said upper notch boundary, the valve terminating at a lower extremity below said cylindrical surface.

8. In an injection nozzle valve having a conical valve seat of a given included angle, a substantially complementary conical body seat, and a given degree of valve lift, a sac having a cylindrical side wall of a given diameter below said conical body seat, a sac entry edge at the bottom of said body seat and at the top of the sac, said conical valve seat extending down the majority of the axial length of said conical body seat from the top thereof along the axial length thereof and into the vicinity of said sac entry edge, a notch machined on said valve seat at the vicinity of said sac entry edge, said notch starting at an uppermost notch edge located such that the diameter at that edge is larger than the sac diameter and the cross-sectional flow area past said edge at said given degree of valve lift is a given value, said notch having an included angle which is greater than the included angle of the valve seat and is such that all cross-sectional flow areas between said uppermost notch edge and said sac entry edge at said given degree of lift are not substantially less than said given value of the cross-sectional flow area past said uppermost notch edge, the innermost section of the notch forming a cylinder on the lower portion of said valve seat, the diameter of said cylinder being of such size that the clearance between said cylindrical portion and said cylindrical sac side wall defines cross-sectional flow areas along the length of said cylinder that are not substantially less than said given value of the cross-sectional flow area past the uppermost notch edge, the cross-sectional flow areas in the vicinity of said sac entrance edge and at the confluence of said included angle and said cylindrical portion of said notch being, at said given degree of lift, not substantially less than said given value of the cross-sectional flow area past said uppermost notch edge, and flow capacity past said sac entry edge therefore being greater than it would be in the absence of said notching.

9. A valve as in claim 8, said valve seat having an included angle of 60°.

10. A valve as in claim 8, said valve seat having an included angle of 90°.

* * * * *